US008528207B2

(12) United States Patent
Lozier

(10) Patent No.: US 8,528,207 B2
(45) Date of Patent: Sep. 10, 2013

(54) VARIABLE VANE CALIBRATION METHOD

(75) Inventor: Thomas S. Lozier, Lebanon, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 159 days.

(21) Appl. No.: 12/859,448

(22) Filed: Aug. 19, 2010

(65) Prior Publication Data

US 2012/0042507 A1 Feb. 23, 2012

(51) Int. Cl.
*B21K 25/00* (2006.01)

(52) U.S. Cl.
USPC ..... 29/889.2; 29/889.4

(58) Field of Classification Search
USPC ..... 29/889.2
See application file for complete search history.

(56) References Cited

U.S. PATENT DOCUMENTS

| | | | | |
|---|---|---|---|---|
| 4,307,994 | A | 12/1981 | Brewer | |
| 5,517,310 | A | 5/1996 | Paquette | |
| 7,116,839 | B2 | 10/2006 | Leboeuf | |
| 7,223,066 | B2 | 5/2007 | Rockley | |
| 2004/0239948 | A1 | 12/2004 | Harding et al. | |
| 2011/0267428 | A1 * | 11/2011 | George et al. | 348/46 |

* cited by examiner

*Primary Examiner* — David P. Bryant
*Assistant Examiner* — Moshe Wilensky
(74) *Attorney, Agent, or Firm* — Krieg DeVault LLP

(57) ABSTRACT

A method for confirming the position of at least one variably positionable turbine vane is disclosed herein. The method includes the step of mounting at least one camera on an exterior of an at least partially assembled turbine engine. The method also includes the step of generating visual data with the at least one camera corresponding to a position of a turbine vane actuation structure positioned on the exterior of the at least partially assembled turbine engine.

15 Claims, 5 Drawing Sheets

VARIABLE VANE CALIBRATION METHOD

BACKGROUND OF THE INVENTION

1. Field of the Invention

The invention relates to a method for calibrating compressor and/or turbine variable vanes in a turbine engine and a kit for executing the method.

2. Description of Related Prior Art

U.S. Pat. No. 4,307,994 discloses a variable vane position adjuster. In the '994 patent, a compressor vane adjustment assembly for calibrating the nozzle/throat width dimension between adjacent adjustable vanes in a nozzle vane ring assembly and for producing conjoint rotation of the individual vane following their calibration includes a vane stem that extends outwardly of a compressor case and further includes a motion converting sleeve in surrounding relationship thereto and "coacting" means between the sleeve and the vane stem that concurrently rotates both the sleeve and the stem and also provides relative axial movement of the sleeve with respect to the vane stem; the adjustment assembly further includes an actuator arm for rotating each of the vanes and means for connecting the actuator arm to the sleeve to cause angular positioning of the actuator arm to be directly transmitted to each of the vanes following calibration thereof. A calibration adjustment nut is located at a point accessible from externally of the compressor case and is associated with the sleeve and operative to axially position it on the vane stem and wherein coacting means on the sleeve and the actuator arm are responsive to axial positioning of the sleeve on the vane stem to rotate it relative to the actuator arm so that the vane stem can be prepositioned to selectively vary the throat width clearance between selected ones of adjacent nozzle vanes in the assembly.

SUMMARY OF THE INVENTION

In summary, the invention is a method and kit for confirming the position of at least one variably positionable vane, such as a compressor vane. The method includes the step of mounting at least one camera on an exterior of an at least partially assembled turbine engine. The method also includes the step of generating visual data with the at least one camera corresponding to a position of a turbine vane actuation structure positioned on the exterior of the at least partially assembled turbine engine.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF AN EXEMPLARY EMBODIMENT

The invention, as demonstrated by the exemplary embodiment described below, provides an enhanced calibration method such that the positions of variable turbine vanes can be controlled so precisely that other engine parameters can be modified upon reliance of this precision. Analog gages have been used to control/calibrate the position of variable turbine vanes. However, analog gages require a human assembler to read a value corresponding to the positions of the vanes (which are defined by angles). If the analog gage is misread (rotated 180 degrees), the human assembler can be fooled. Digital gages are currently used in place of analog gages. However, digital gages are less precise than analog gages in the sense that digital gages consume more of the tolerance of the vane position. For example, an analog gage can consume around twenty-eight percent of the tolerance of the vane position. In other words, when the analog gage indicates that a vane is in a particular position, the true vane position is within a band or range of values defined by about twenty-eight percent of the overall tolerance for the vane position. The vane's position is ±14% of the value displayed by the analog gage. When the digital gage indicates that a vane is in a particular position, the true vane position is within a band or range of values defined by about eighty percent of the overall tolerance for the vane position. The vane's position is ±40% of the value displayed by the digital gage.

The embodiment of the invention described below consumes about thirteen to seventeen percent of the tolerance of the vane position. This level of precision yields a higher level of control over the vane position and allows other parts of the turbine engine be designed and/or operated over a broader range and at a higher level of performance. In one embodiment, the physical rpm of a turbine engine was decreased by thirty rpm after the vanes were calibrated, while producing the same amount of power. Also, embodiments of the invention have reduced calibration time by about one hour per engine.

Figure 1:
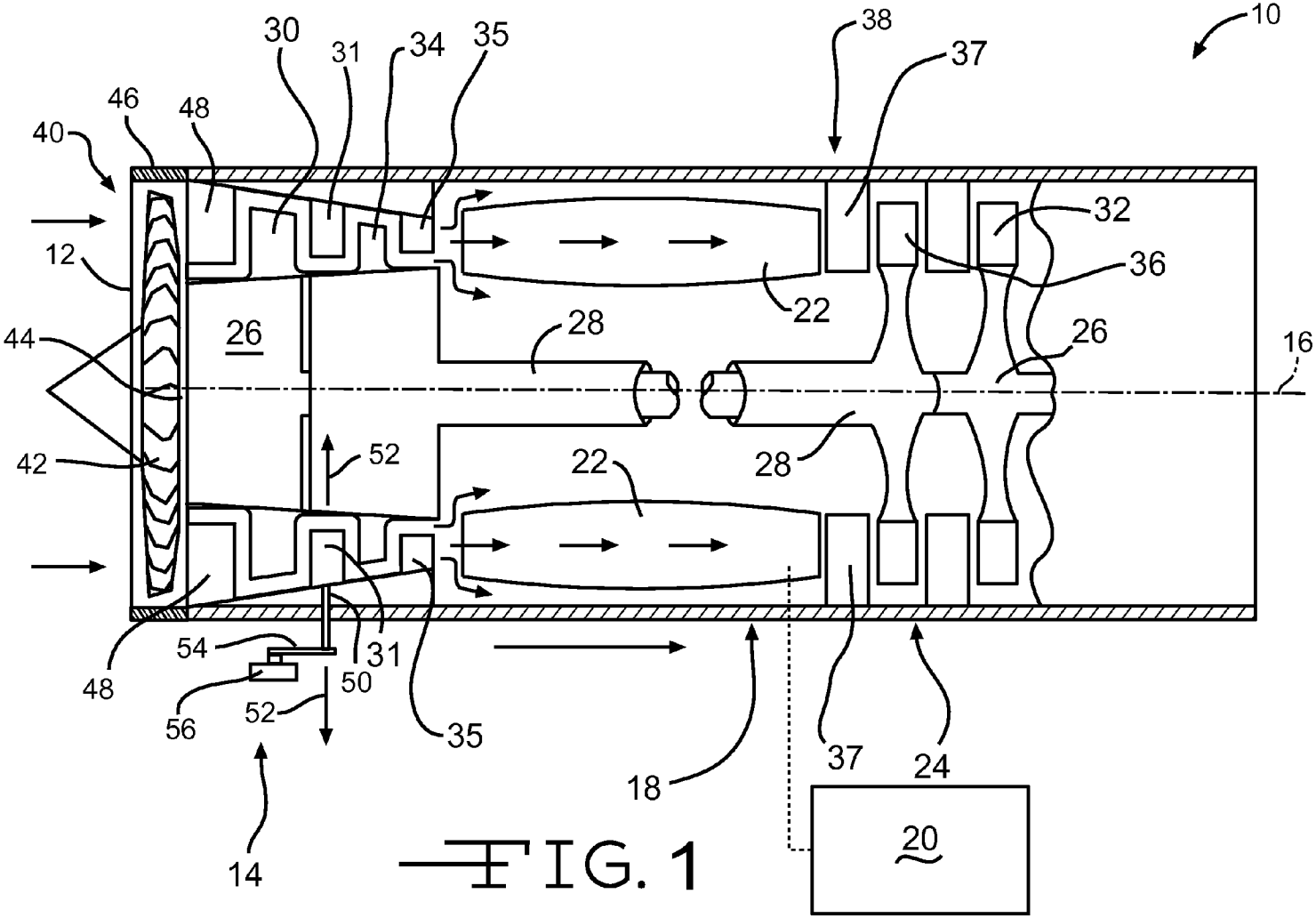
FIG. 1 is a schematic cross-section of a turbine engine with variable vanes that can be calibrated according to an exemplary embodiment of the invention.

FIG. 1 schematically shows a turbine engine 10. The various unnumbered arrows represent the flow of fluid through the turbine engine 10. The turbine engine 10 can produce power for several different kinds of applications, including vehicle propulsion and power generation, among others. The exemplary embodiments of the invention disclosed herein, as well as other embodiments of the broader invention, can be practiced in any configuration of a turbine engine and in any application other than turbine engines in which inspection of difficult to access components is desired or required.

The exemplary turbine engine 10 can include an inlet 12 to receive fluid such as air. The turbine engine 10 can include a fan to direct fluid into the inlet 12 in alternative embodiments of the invention. The turbine engine 10 can also include a compressor section 14 to receive the fluid from the inlet 12 and compress the fluid. The compressor section 14 can be spaced from the inlet 12 along a centerline axis 16 of the turbine engine 10. The turbine engine 10 can also include a combustor section 18 to receive the compressed fluid from the compressor section 14. The compressed fluid can be mixed with fuel from a fuel system 20 and ignited in an annular combustion chamber 22 defined by the combustor section 18. The turbine engine 10 can also include a turbine section 24 to receive the combustion gases from the combustor section 18.

The energy associated with the combustion gases can be converted into kinetic energy (motion) in the turbine section 24.

In FIG. 1, shafts 26, 28 are shown disposed for rotation about the centerline axis 16 of the turbine engine 10. Alternative embodiments of the invention can include any number of shafts. The shafts 26, 28 can be journaled together for relative rotation. The shaft 26 can be a low pressure shaft supporting compressor blades 30 of a low pressure portion of the compressor section 14. A plurality of vanes 31 can be positioned to direct fluid downstream of the blades 30. The shaft 26 can also support low pressure turbine blades 32 of a low pressure portion of the turbine section 24. For example, the high pressure turbine can be associated with shaft 28 can provide power to drive the compressor section 14 and the low pressure turbine associated with shaft 26 can provide power to the propeller, fan or shaft.

The shaft 28 encircles the shaft 26. As set forth above, the shafts 26, 28 can be journaled together, wherein bearings are disposed between the shafts 26, 28 to permit relative rotation. The shaft 28 can be a high pressure shaft supporting compressor blades 34 of a high pressure portion of the compressor section 14. A plurality of vanes 35 can be positioned to receive fluid from the blades 34. The shaft 28 can also support high pressure turbine blades 36 of a high pressure portion of the turbine section 24. A plurality of vanes 37 can be positioned to direct combustion gases over the blades 36.

The compressor section 14 can define a multi-stage compressor, as shown schematically in FIG. 1. A "stage" of the compressor section 14 can be defined as a pair of axially adjacent blades and vanes. For example, the vanes 31 and the blades 30 can define a first stage of the compressor section 14. The vanes 35 and the blades 34 can define a second stage of the compressor section 14. The invention can be practiced with a compressor having any number of stages.

A casing 38 defines a first wall and can be positioned to surround at least some of the components of the turbine engine 10. The exemplary casing 38 can encircle the compressor section 14, the combustor section 18, and the turbine section 24. In alternative embodiments of the invention, the casing 38 may encircle less than all of the compressor section 14, the combustor section 18, and the turbine section 24.

FIG. 1 shows the turbine engine 10 having a fan 40 positioned forward of the compressor section 14 along the centerline axis 16. The fan 40 can include a plurality of blades 42 extending radially outward from a hub 44. The fan 40 can be encircled by a fan case 46. The fan case 46 can be fixed to the casing 38. The casing 38 is shown schematically as being a single structure. In some embodiments of the invention, the casing 38 can be a single structure. In other embodiments of the invention, the casing 38 can be formed from a plurality of members that are fixed together. The forward-most member can be designated as a "front frame." The fan case 46 can be mounted to a front frame portion of the casing 38.

FIG. 1 also shows that the vanes 31 and 35 can be variable. In other words, the vanes 31, 35 can be pivoted about respective axes to vary the flow of fluid through the turbine engine 10. The turbine engine 10 can also include inlet guide vanes 48 that can be pivoted about respective axes to vary the flow of fluid through the turbine engine 10. For example, the vane 31 can include a stem 50 centered on an axis 52. It is noted that the two vanes marked 31 are distinct vanes; likewise the vanes marked 35 and 48 are distinct. The vane 31 can be pivoted about the axis 52. The stem 50 can be pivotally connected to a link arm 54 and the link arm 54 can be connected to a ring 56. The ring 56 can be rotated about the axis 16. Rotation of the ring 56 about the axis 16 can cause the link arm 54 to pivot and thereby move the vane 31 about the axis 52.

Figure 2:
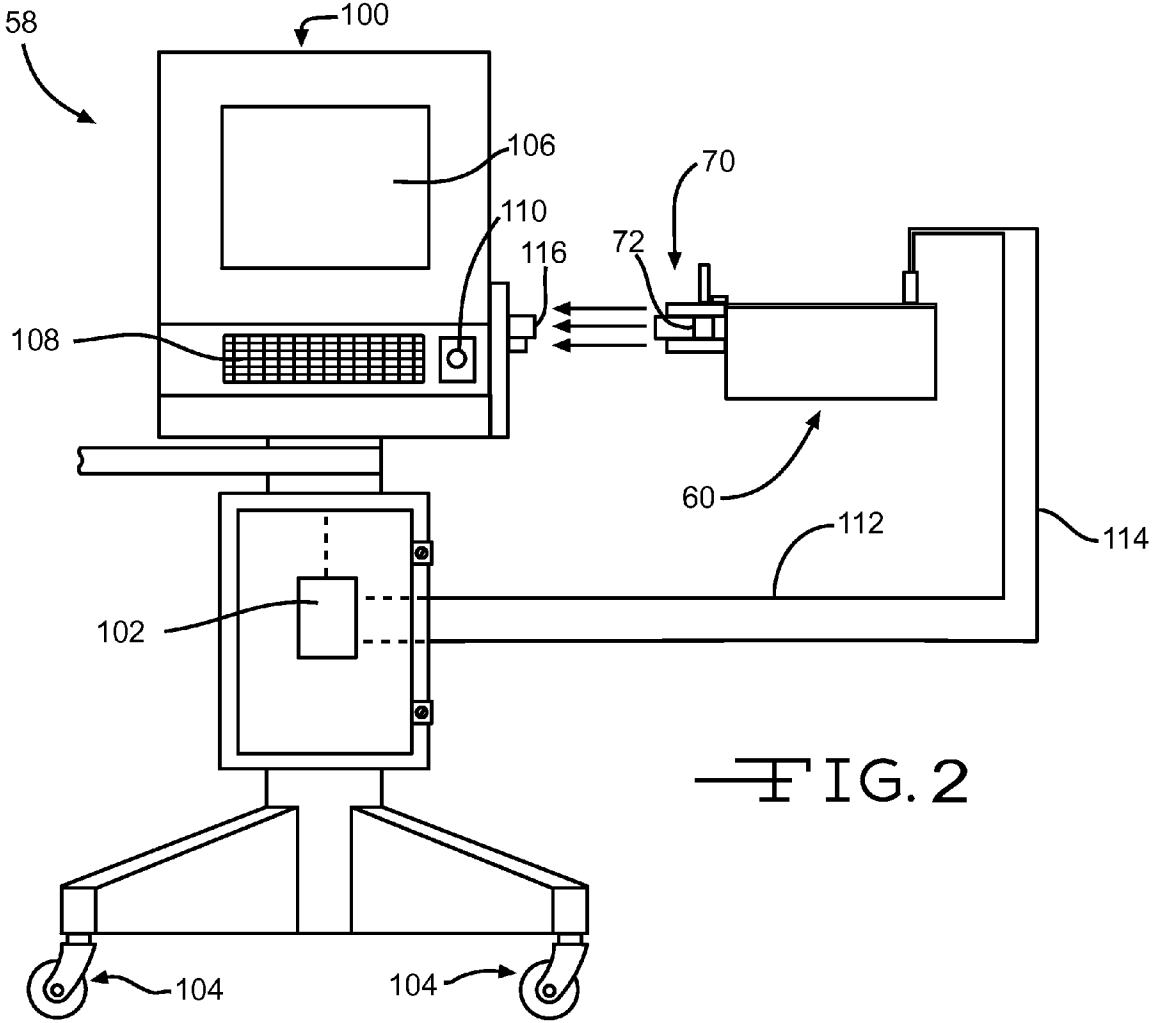
FIG. 2 is an exploded view of a calibration module, camera, and fixture of a kit according to an embodiment of the invention.

FIG. 2 is an exploded view of kit for confirming the position of the vanes, such as vanes 31, 35, and 48 shown in FIG. 1. The method and kit according to the exemplary embodiment of the invention can be applied to turbine engines that are fully assembled and to turbine engines that are less than fully assembled. The exemplary embodiment has been applied to turbine engines intended for aircraft propulsion, but the exemplary embodiment and other embodiments of the invention can be applied to turbine engines in other operating environments.

The exemplary embodiment provides a method for confirming the position of variably positionable turbine vanes. The position can be "confirmed" in that a current position of one or vanes can be detected or assessed. The position can also be "confirmed" in the sense that the position can be changed to a desired or calibrated position. In the exemplary embodiment, the position of a vane corresponds to an angle, but the position could correspond to other forms of data in alternative embodiments of the invention.

Figure 5:
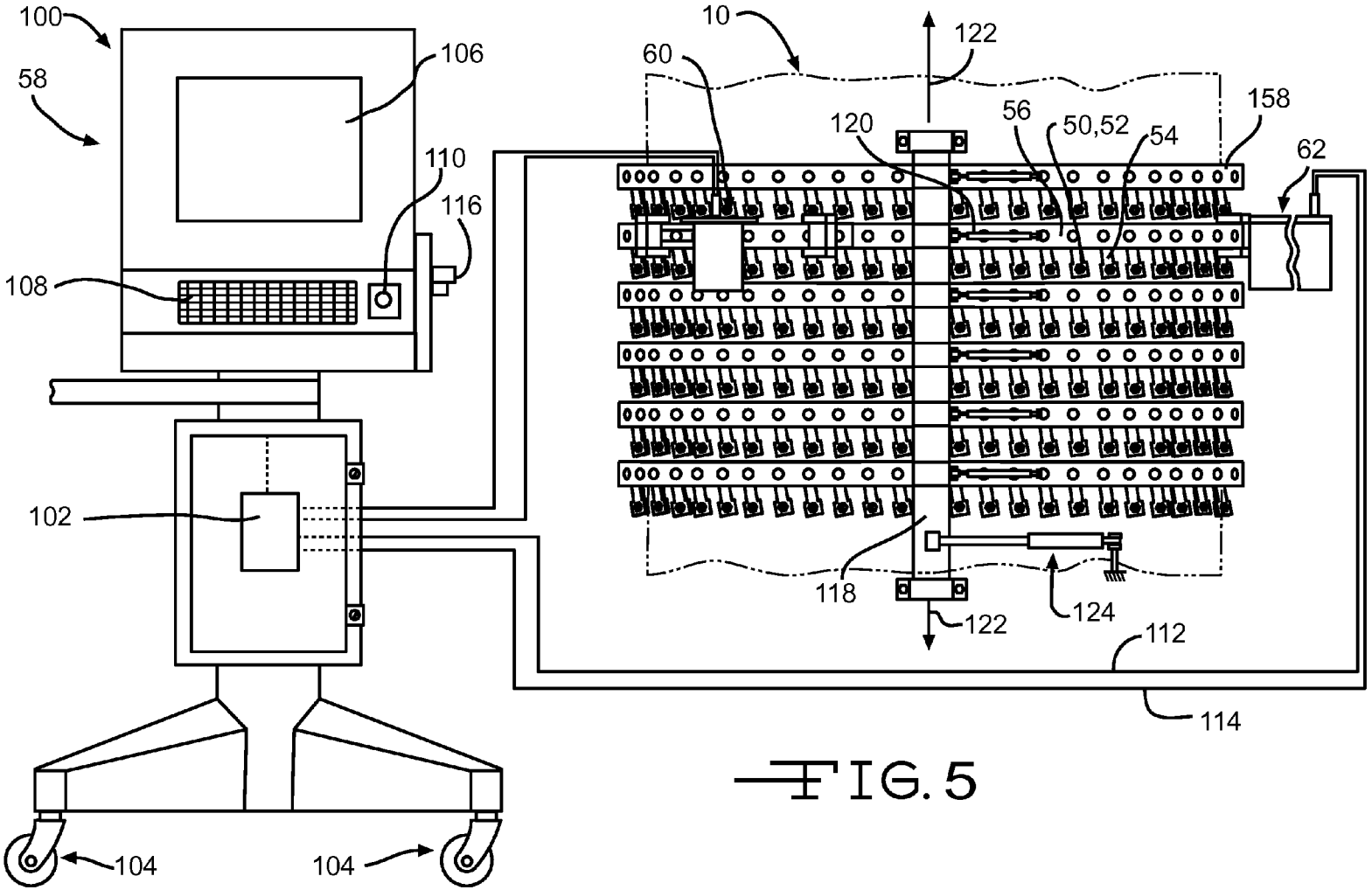
FIG. 5 is a plan view of the kit shown in FIG. 2 applied to an at least partially assembled turbine engine.

Kits according to various embodiments of the invention can include at least one camera operable to generate visual data. The exemplary kit 58 includes first and second cameras 60, 62 (camera 62 is shown in FIG. 5). The cameras 60, 62 can be substantially similar if not identical; therefore camera 60 will be described in detail and this description also applies to camera 62 in the exemplary embodiment of the invention.

Figure 3:
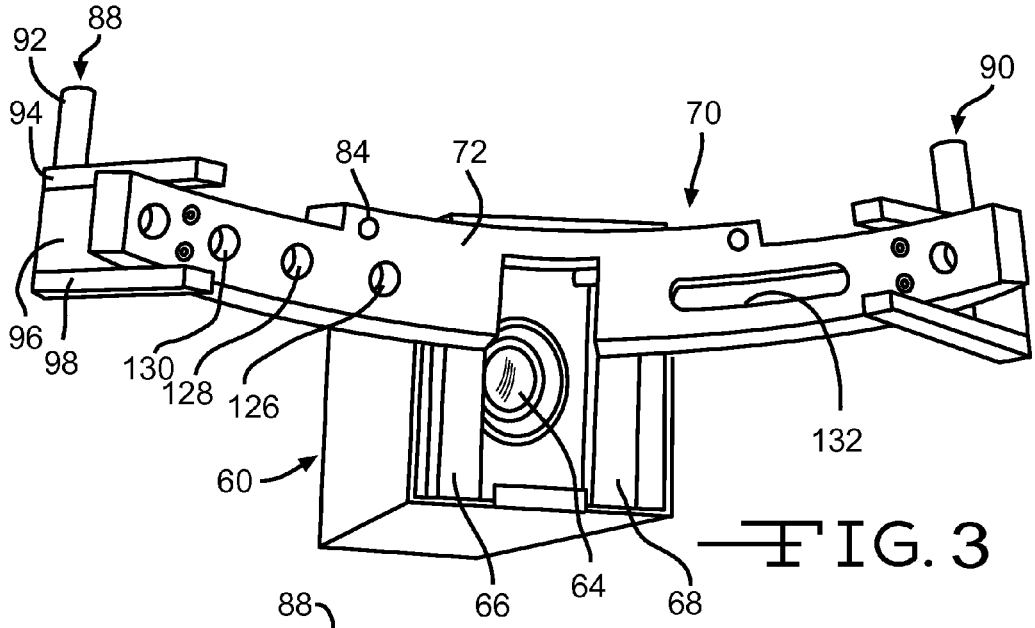
FIG. 3 is a perspective view of a camera and fixture according to an embodiment of the invention.

As shown in FIG. 3, the camera 60 can include a lens 64 for receiving images. First and second light bars 66, 68 can be positioned on opposite sides of the lens 64 to enhance the capacity of the camera 60 to capture a detailed view of the structures to be observed. The camera 60 can be a Sony® XC HR70 Machine Vision Camera and incorporate a Cognex frame grabber and breakout module. The camera 60 can acquire images for assessment. The breakout module can provide an input/output interface. The frame grabber can provide power to the camera through the camera cable. The light bars 66, 68 can be supplied by CCS America and be controlled by a signal to a variable strength strobe controller.

Figure 4:
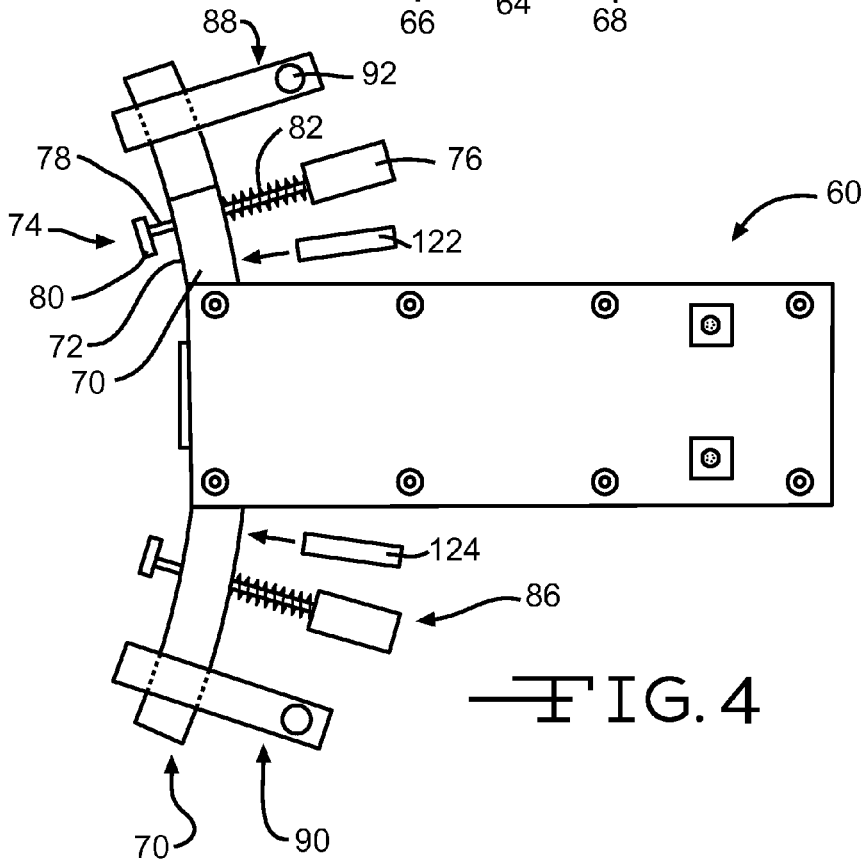
FIG. 4 is a top view of the camera and fixture shown in FIG. 3.

As shown in FIGS. 3 and 4, a bracket or fixture 70 can be engaged with the camera 60 for mounting the camera 60 to the at least partially assembled turbine engine 10 (referenced in FIG. 1). The fixture 70 can be shaped to conform to an exterior portion of the turbine engine 10. The exemplary fixture 70 can include a mounting surface 72 operable to mate with a surface defined on an exterior of an at least partially assembled turbine engine 10 such that when the at least one camera 60 is mounted to the at least partially assembled turbine engine 10 the at least one camera 60 is positioned to generate visual data corresponding to a position of a turbine vane actuation structure positioned on the exterior of the at least partially assembled turbine engine 10. The exemplary mounting surface 72 is arcuate and operable to conform to a radially-outer surface of the ring 56 (referenced in FIGS. 1 and 5) and the turbine vane actuation structure to be observed can be the link arm 54.

A turbine engine typically includes more than one vane actuation ring such as ring 56. The mounting surface 72 can be shaped to correspond to the largest diameter of these rings so that the fixture can be mounted on all of the rings. The fixture 70 is thus operable to engage a plurality of differently-configured surfaces on the exterior of the at least partially assembled turbine engine 10. A plurality of clamps can be positioned on the fixture 70 and the clamps can be arranged to accommodate size differences between the differently-configured surfaces on the exterior of the at least partially assembled turbine engine 10. In the exemplary embodiment, a first clamp 74 includes a handle 76, a rod 78 fixed to the handle 76, a latch portion 80 fixed to the rod 78, and a spring 82. The rod 78 can extend through an aperture 84 in the fixture 70. In operation, the handle 76 can be urged toward the fixture 70, thereby compressing the spring 82, until the latch portion 80 is radially inward of the ring 56. The handle 76 can then be rotated until a cantilevered end of the latch portion 80 is behind the ring 56. The handle 76 can then be released, allowing the spring 82 to bias the handle 76 radially outward and press the latch portion 80 against the radially-inner surface of the ring 56. A second clamp 86 like the first clamp 74 can be positioned on an opposite side of the fixture 70. It is noted that the clamps 74 and 86 are not shown in FIG. 3 in order to more clearly show the mounting surface 72.

To further enhance the stability of the camera 60, clamps 88 and 90 can be positioned on opposite sides of the fixture 70. The clamps 88, 90 can be similarly constructed. Clamp 88 can include a handle 92 with a rod (not visible) that interconnects three plates 94, 96, 98. The plate 96 can be desirable to limit to the extent of radially-inward travel of the clamp 88 relative to the ring 56. Turning the handle 92 in a first angular direction can cause the plates 94 and 98 to move closer together to pinch the ring 56 between the cantilevered ends of the plates 94 and 98. Turning the handle in a second angular direction opposite the first angular direction can cause the plates 94 and 98 to move apart from one another and release the ring 56.

Referring again to FIG. 2, the exemplary kit 58 can also include a module 100 housing a processor 102 operable to receive visual data from the at least one camera 60 and convert the visual data into a numerical value corresponding to the position of a turbine vane actuation structure. The exemplary module 100 can be a moveable structure mounted on casters 104. The module 100 can also support a monitor screen 106 for providing a graphical user interface and display. The monitor screen 106 can be controlled by the processor 102. The module 100 can also support a keyboard 108 and mouse 110. Power and communication wires/cables 112, 114 can extend between the camera 60 and the processor 102.

At the start of an exemplary method for confirming the position of at least one variably positionable turbine vane, the camera 60 can be mounted on the module 100 to calibrate (or confirm calibration of the camera 60). The module 100 can define a surface 116 operable to receive the mounting surface 72 of the fixture 70. The processor 102 is operable to receive visual images from the camera 60 when the mounting surface 72 is received by the surface 116 of the module 100 and confirm a calibration of the camera 60 and the fixture 70.

After calibration of the camera 60, the camera 60 can be mounted to the at least partially assembled turbine engine 10. FIG. 5 shows the at least partially assembled turbine engine 10 having a plurality of vane-actuating rings, such as ring 56. Each of the rings can be formed from two ring halves connected together to form a 360 degree ring. Each ring can be connected to a torque tube 118 by respective turnbuckles 120. The torque tube 118 can be pivoted about its central axis 122 by an actuator 124. When the torque tube 118 is rotated in a first angular direction, the rings rotate about the centerline axis 16 (which is parallel and spaced from the axis 122) in a first angular direction. When the torque tube 118 is rotated in a second angular direction opposite the first angular direction, the rings rotate about the centerline axis 16 in a second angular direction opposite the first angular direction.

Each ring can be pivotally connected to a plurality of link arms, such as link arm 54. Each link arm 54 can be connected to a variable turbine vane, such as through a stem 50. The vane rotates about an axis 52 which extends out of the page in FIG. 5. The camera 60 can be mounted to the ring 56 by directing a first pin 122 through one of the apertures 126, 128, 130 in the fixture 70 (see FIGS. 3 and 4) and also through an aperture in the ring 56. Also, a pin 124 can be directed through the aperture 132 in the fixture 70 (see FIGS. 3 and 4) and also through an aperture in the ring 56. The aperture 132 can be slot like to ease the assembly of both pins 122, 124 by simplifying alignment of the various apertures. Next, the clamps 74, 86, 88, and 90 can be engaged as described above to fix the camera 60 to the ring 56 through the fixture 70. The camera 60 is thus mounted on the exterior of the at least partially assembled turbine engine 10.

The second camera 62 can be mounted similarly. The cameras 60, 62 can be spaced at least forty-five degrees apart from one another about the centerline axis 16 of the turbine engine 10. The exemplary embodiment includes two cameras 60, 62, but any number of cameras can be applied in alternative embodiments of the invention.

It is noted that the processor 102 can be operable to assess the visual data received from one or both cameras 60, 62 to confirm that the respective camera is mounted on a particular ring from among a plurality of differently-sized rings. For example, the processor 102 can be programmed with the desirable position for each variable vane. The desirable position for each vane can vary for the various stages of the compressor. Prior to placement of the cameras 60, 62, the processor 102 can receive input from an operator relating to the particular compressor stage being calibrated or can dictate to the operator which stage to calibrate. The visual display observed by the camera and communicated to the processor 102 can be different for different rings because the rings are slightly different in size. When the cameras 60, 62 are first assembled to the ring 56, the processor 102 can assess the visual data and if the cameras 60, 62 are not positioned on the appropriate ring, the processor 102 can emit an error message to the operator.

After the cameras 60, 62 are mounted on the appropriate ring of the at least partially assembled turbine engine 10, the processor 102 can control the monitor screen 106 to provide a graphical user interface and/or display for the operator. The monitor screen 106 can display the positions of the link arms viewed by the cameras.

Figure 6:
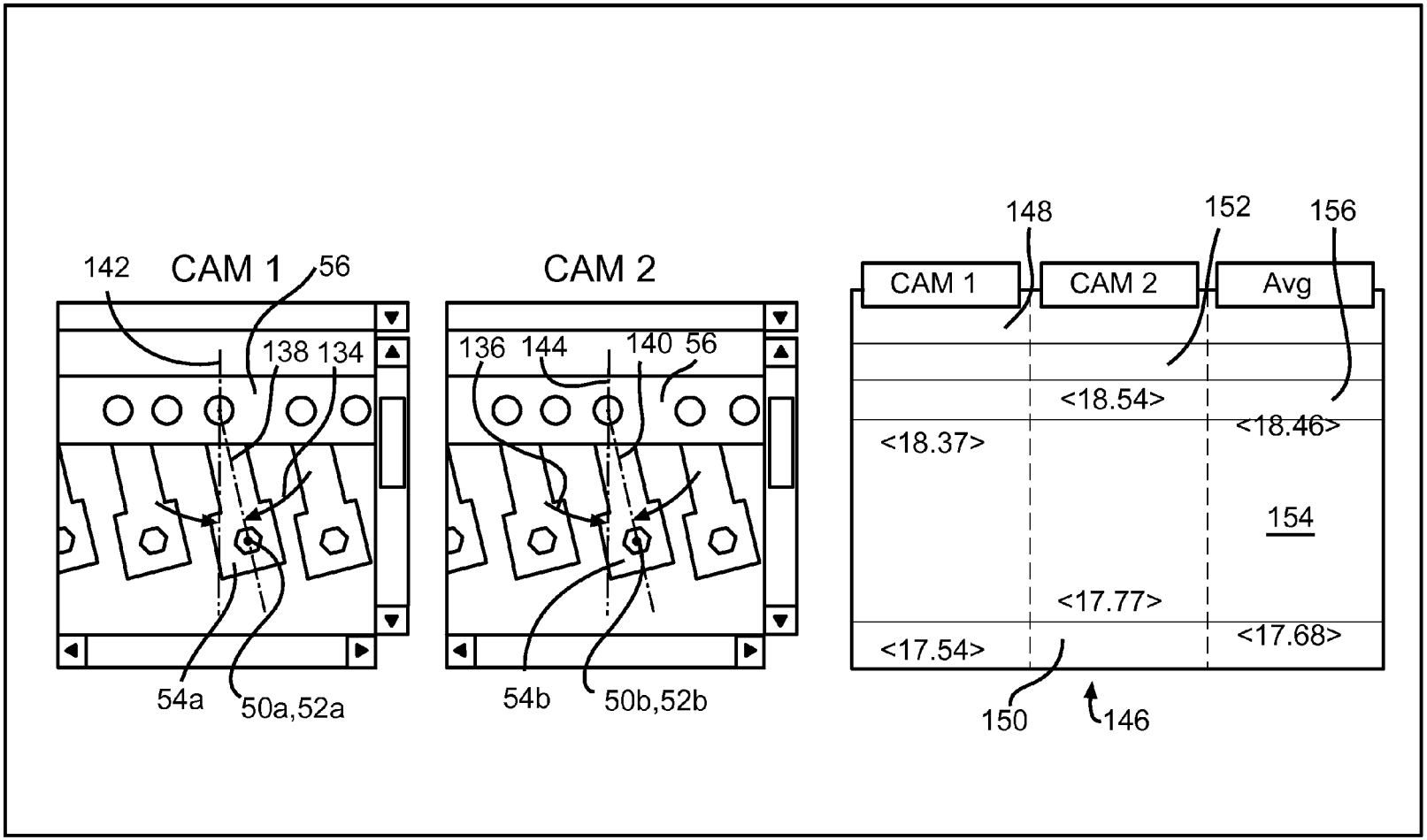
FIG. 6 is an exemplary screen shot that can be displayed by an embodiment of the invention.

FIG. 6 shows an exemplary screen shot in which a link arm 54*a* viewed by the camera 60 is displayed and a link arm 54*b* viewed by the camera 62 is displayed. The link arm 54*a* is connected to a stem 50*a* of variable turbine vane that can rotate about a pivot axis 52*a* (extending out of the paper). The link arm 54*b* is connected to a stem 50*b* of variable turbine vane that can rotate about a pivot axis 52*b* (extending out of the paper).

The visual data corresponds to a position of a turbine vane actuation structure positioned on the exterior of the at least partially assembled turbine engine 10. In the exemplary embodiment, the turbine vane actuation structure is a link arm for both cameras 60, 62. Other structures can be observed in alternative embodiments of the invention. The respective positions of the link arms 54*a* and 54*b* are defined by angles referenced at 134 and 136 respectively. The angles 134, 136 are defined between respective longitudinal axes 138, 140 of the link arms 54*a*, 54*b* and respective longitudinal axes 142, 144 of the at least partially assembled turbine engine 10. A longitudinal axis of the turbine engine 10 can extend between a forward end of the turbine engine 10 and an aft end. The centerline axis 16 of the turbine engine 10 is one longitudinal axis of the turbine engine. In FIG. 6, the respective axes 142, 144 extend parallel to and spaced from the centerline axis 16 shown in FIG. 1.

The positions of the link arms 54*a*, 54*b* can be shown relative to one another in a field defining at least two of preferred values, acceptable values, and unacceptable values. FIG. 6 shows a portion of the graphical display being a field 146. An exemplary initial value for the angle referenced at 134 is shown to be "17.54." An exemplary initial value for the angle referenced at 136 is shown to be "17.77." The average of these two values is shown to be "17.68." These values are positioned in the field 146. The field 146 can be divided into different-colored areas. In FIG. 6, the areas are distinguished by solid horizontal lines. Areas 148 and 150 can be colored red to represent values that are out of tolerance. Areas 152 and 154 can be colored yellow to represent values that are acceptable but not preferred. Area 156 can be colored green to represent values that are preferred. In the example, the angle 134 associated with the link arm 54*a* is out of tolerance and the angle 136 associated with the link arm 54*b* is within tolerance but not preferred. The average of the two values is out of tolerance.

The positions of the link arms 54*a*, 54*b* can be assessed and then adjusted. Referring again to FIG. 5, the turnbuckle 120 can be adjusted to adjust the positions of the ring 56 relative to the torque tube 118 such that the average of the positions of the link arms 54*a*, 54*b* changes to a desired value. During adjustment, the processor 102 can be adjusting the values displayed in the field 146 in real time. For example, the numerical values displayed in the field 146 can change and the positions of the values within the field 146 can change. At the completion of adjustment in the example, an exemplary final value for the angle referenced at 134 is shown to be "18.37," an exemplary final value for the angle referenced at 136 is shown to be "18.54," and the average of these two values is shown to be "18.46." During adjustment, the values were moving upward and changing. After adjustment all of the values are now within acceptable tolerances and the value of angle 136 is preferred. The average of the values is almost preferred. Embodiments of the invention can be practiced in numerous ways. For example, the turnbuckle 120 can be adjusted until the average of the angles is preferred.

After the final positions are established, the ring 56 can be moved between first and second opposite end limits of travel by the torque tube 118, returning to the initial position to ensure the modified link arm positions remain established at the adjusted values. The cameras 60, 62 can continue to generate visual data for processing by the processor 102 and for display on the monitor 106 during this movement. After the vanes connected to the first ring 56 have thus been calibrated, the first and second cameras 60, 62 can be disconnected from the ring 56 and mounted to a second ring 158 spaced from the ring 56 along the centerline axis. The first and second cameras 60 and 62 are thus connectible to both the first and second rings 56, 158 with the same fixture 70.

It is noted that components for producing embodiments of the invention can be acquired from Clarke Engineering Services, Inc., located at 9114 Technology Lane, Fishers, Ind. 46038-2839.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Further, the "invention" as that term is used in this document is what is claimed in the claims of this document. The right to claim elements and/or sub-combinations that are disclosed herein as other inventions in other patent documents is hereby unconditionally reserved.

What is claimed is:

1. A method for confirming the position of at least one variably positionable turbine vane comprising the steps of:

mounting a plurality of cameras on an exterior of an at least partially assembled turbine engine;

spacing the cameras at least forty-five degrees apart from one another about a centerline axis of the turbine engine; and generating visual data with the cameras corresponding to a position of a turbine vane actuation structure, the turbine vane actuation structure positioned on the exterior of the at least partially assembled turbine engine.

2. The method of claim 1 wherein said generating step is further defined as:

generating visual data with the at least one camera corresponding to the position of the turbine vane actuation structure positioned on the exterior of the at least partially assembled turbine engine such that the visual data corresponds to an angle between a longitudinal axis of the turbine vane actuation structure and a longitudinal axis of the turbine engine.

3. The method of claim 1 wherein said mounting step is further defined as:

mounting a plurality of cameras on the exterior of the at least partially assembled turbine engine.

4. The method of claim 3 wherein said generating step is further defined as:

generating different visual data with each of the plurality of cameras, the data of each camera corresponding to the position of a different turbine vane actuation structure positioned on the exterior of the at least partially assembled turbine engine.

5. The method of claim 3 wherein said mounting step is further defined as:

mounting only two cameras on the exterior of the at least partially assembled turbine engine.

6. The method of claim 1 further comprising the step of:

changing the position of the turbine vane actuation structure during said generating step.

7. A method for confirming the position of at least one variably positionable turbine vane comprising the steps of:

mounting at least one camera on a moving component disposed on an exterior of an at least partially assembled turbine engine; and generating visual data with the at least one camera corresponding to a position of a turbine vane actuation structure, the turbine vane actuation structure positioned on the exterior of the at least partially assembled turbine engine.

8. A method for confirming the position of at least one variably positionable turbine vane comprising the steps of:

mounting at least one camera on a first ring interconnected with a plurality of variable turbine vanes and also connected to a torque tube through a turnbuckle, the first ring being disposed on an exterior of an at least partially assembled turbine engine; and generating visual data with the at least one camera corresponding to a position of a turbine vane actuation structure positioned on the exterior of the at least partially assembled turbine engine wherein the turbine vane actuation structure is a link arm pivotally connected to the first ring and fixedly connected to a variable turbine vane and the position of the variable turbine vane is defined by an angle between a longitudinal axis of the link arm and a longitudinal axis of the at least partially assembled turbine engine.

9. The method of claim 8 further comprising the step of:

assessing the visual data to confirm that the at least one camera is mounted on a particular ring from among a plurality of differently-sized rings.

10. The method of claim 9 wherein said mounting step is further defined as:

mounting first and second cameras on the first ring spaced apart from one another about a centerline axis of the at least partially assembled turbine engine, each of the first and second camera generating visual data corresponding to different variable turbine vanes.

11. The method of claim 10 further comprising the steps of:

assessing the positions of the different variable turbine vanes; and adjusting the position of the first ring relative to the torque tube such that the average of the positions of the different variable turbine vanes changes to a desired value.

12. The method of claim 11 wherein said adjusting step is concurrent with said generating step.

13. The method of claim 12 further comprising the steps of:

disconnecting the first and second cameras from the first ring; and mounting the first and second cameras on a second ring spaced from the first ring along the centerline axis after said disconnecting step, wherein the first and second cameras are connectible to both the first and second rings with the same fixture.

14. The method of claim 13 further comprising the step of:

moving the link arms between first and second opposite end limits of travel during said generating step to confirm the average of the positions is maintained.

15. The method of claim 10 further comprising the step of:

providing a graphical user interface displaying the positions of more than one link arms relative to one another in a field defining at least two of preferred values, acceptable values, and unacceptable values.

* * * * *